US006332615B1

(12) United States Patent
Watanabe

(10) Patent No.: US 6,332,615 B1
(45) Date of Patent: Dec. 25, 2001

(54) SET OF CARDS USED FOR PLAYING A CARD GAME SIMULATING FISHING

(75) Inventor: Shunjiro Watanabe, Matsudo (JP)

(73) Assignee: COMS Corporation, Tokyo (JP)

( * ) Notice: Subject to any disclaimer, the term of this patent is extended or adjusted under 35 U.S.C. 154(b) by 0 days.

(21) Appl. No.: 09/401,945

(22) Filed: Sep. 23, 1999

(30) Foreign Application Priority Data

Sep. 24, 1998 (JP) ..... 10-285875

(51) Int. Cl.[7] ..... A63F 1/00
(52) U.S. Cl. ..... 273/298; 273/308
(58) Field of Search ..... 273/243, 244, 273/259, 292, 298, 308

(56) References Cited

U.S. PATENT DOCUMENTS 2,072,799 * 3/1937 Creswell ..... 273/292
3,921,981 * 11/1975 Ashburn ..... 273/244
5,176,385 * 1/1993 Tagliaferro ..... 273/244
5,876,034 * 3/1999 Stafford ..... 273/244

FOREIGN PATENT DOCUMENTS

2123304 * 2/1984 (GB) ..... 273/244

* cited by examiner

*Primary Examiner*—Benjamin H. Layno
(74) *Attorney, Agent, or Firm*—McDermott, Will & Emery

(57) ABSTRACT

A card set with which a complicated and interesting game simulating fishing can be enjoyed. The card set for game comprises point cards and player cards. The point cards comprise positive point cards of different kinds respectively indicating different positive numbers, and negative point cards of different kinds respectively indicating different negative numbers. The player cards comprise point capture cards of different kinds respectively capturable of at least one of the positive point cards, and hit cards to be used with the point capture cards. A player can draw a point card by presenting on the table a combination of a hit card and a point capture card selected from player cards which the player has drawn. Only when the drawn point card corresponds with the presented point capture card, the player can capture the point card. A winner is determined by the total points of obtained point cards.

10 Claims, 7 Drawing Sheets

6

7

SET OF CARDS USED FOR PLAYING A CARD GAME SIMULATING FISHING

BACKGROUND OF THE INVENTION

1. Field of the Invention

The present invention relates to a set of cards for game.

2. Description of the Related Art

As conventional game cards, there are known playing-cards, UNO cards, etc. Among these cards, the playing-cards basically comprise one kind of cards as seen from the view of their usage, so that various games are played using each card sometimes as a card in a player's hand and sometimes as a card to be placed face up on a table.

With the above type of game cards, only simple games can be played since each of those sets of cards comprises only a small number of different kinds of cards.

SUMMARY OF THE INVENTION

An object of the present invention is to provide a set of cards for game with which a complicated and interesting game can be enjoyed by combining different kinds of point cards and a plurality of kinds of player cards.

A set of cards for game of the present invention comprises: a plurality of point cards including positive point cards of different kinds respectively indicating different positive numbers, and negative point cards of different kinds respectively indicating different negative numbers; and a plurality of player cards including point capture cards of different kinds respectively capturable of at least one of the positive point cards, and hit cards to be used in combination with the point capture cards.

The point card may include a point losing card which forces a player to lose all of the positive point cards captured by the player.

The point cards may include a rest card which forces a player to take a rest at next turn.

The player cards may include an action card which allows a player to take an action.

The action card may comprises a steal card which allows a player to steal a positive point card captured by another player, a change card which allow a player to exchange one point card which the player captured with one point card captured by another player, a release card which allows a player to return one point card captured by the player or one point card captured by another player on a table, all-change card which allows a player to exchange all of the point cards captured by the player with all of the point cards captured by another player, a stop card which allows a player to cancel any action demanded by another action card.

The positive point cards and negative point cards may have different colors on revere sides thereof, so that the point cards and the player cards can be easily distinguished when they are placed on the table.

DETAILED DESCRIPTION OF THE PREFERRED EMBODIMENT

Figure 1:
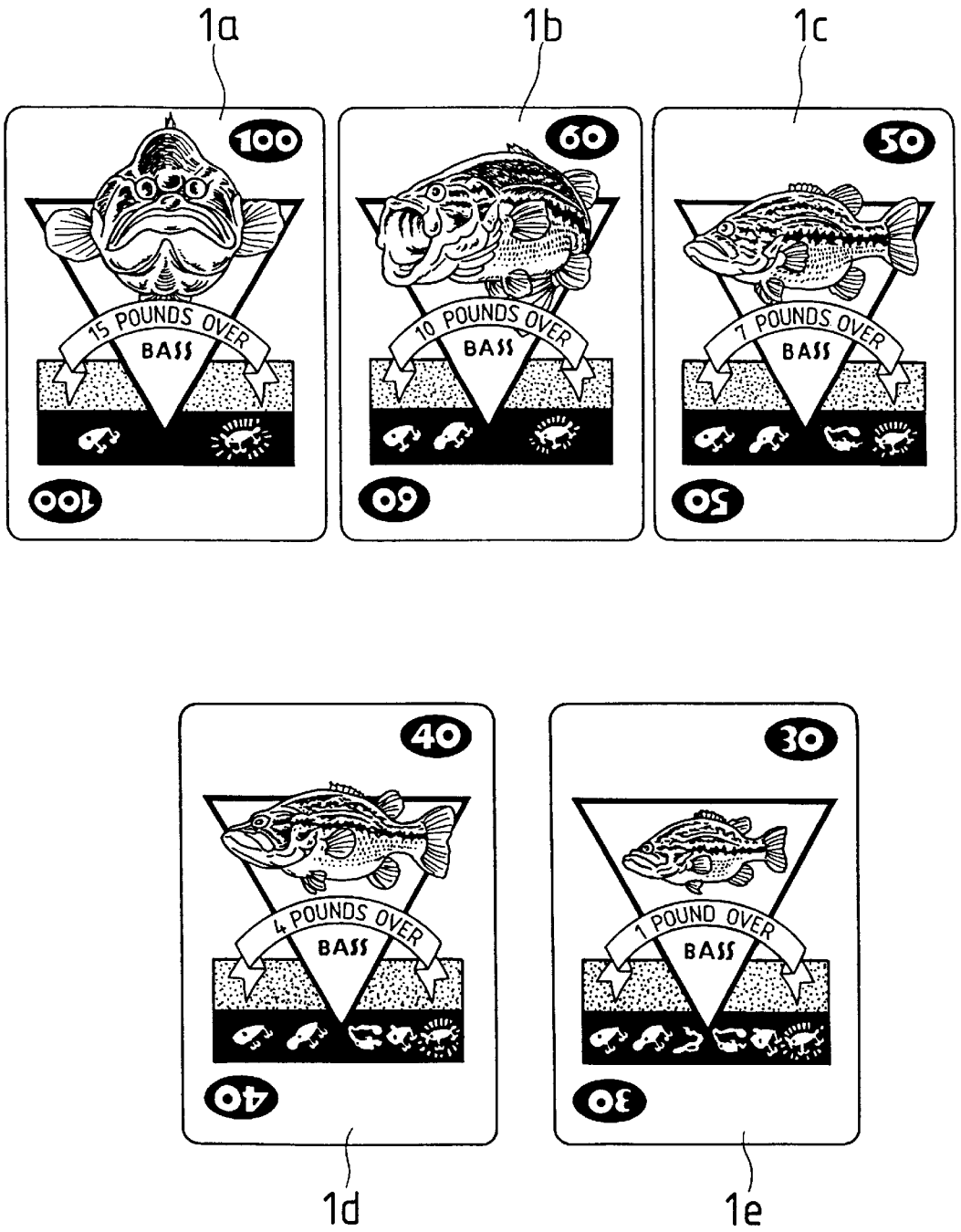
FIG. 1 shows observe sides of positive point cards.

A set of cards for game according to this embodiment is prepared for playing a game imitating fishing such as bass fishing. The card set consists of 135 cards, that is, 87 point cards, 42 player cards, 3 spare point cards and 3 spare player cards.

The reverse sides of the point cards and those of the player cards are different in color so that the point cards and the player cards can be distinguished easily only at the sight of their reverse sides.

The point cards comprise five kinds of positive point cards 1*a*–1*e* (FIG. 1) respectively indicating different positive points and called "bass cards" in this embodiment, three kinds of negative point cards 2*a*–2*c* (FIG. 2) respectively indicating different negative points, point lose cards 3 (FIG. 3) called "sinking cards", and rest cards 4 (FIG. 4) called "stuck cards". In the drawings, the point lose card 3 and the rest card 4 are depicted different in size from the positive point cards 1*a*–1*e* and the negative point cards 2*a*–2*c*, but actually they are all of the same size.

When a player captures one of positive point cards 1*a*–1*e*, the points indicated thereon are added to the player's points. There are prepared twenty-eight positive point cards 1*a*–1*e*, that is, two 15 pounds-OVER cards 1*a* with which 100 points are added, five 10 pounds-OVER cards 1*b* with which 60 points are added, six 7 pounds-OVER cards 1*c* with which 50 points are added, seven 4 pounds-OVER cards 1*d* with which 40 points are added, and eight 1 pound-OVER cards 1*e* with which 30 points are added, as shown in FIG. 1.

Each positive point card 1*a*–1*e* shows, on the observe side, positive points, a card name, an image of a bass having a size corresponding to the positive points, and images of corresponding point capture cards 5*a*–5*f* (described later).

Figure 2:
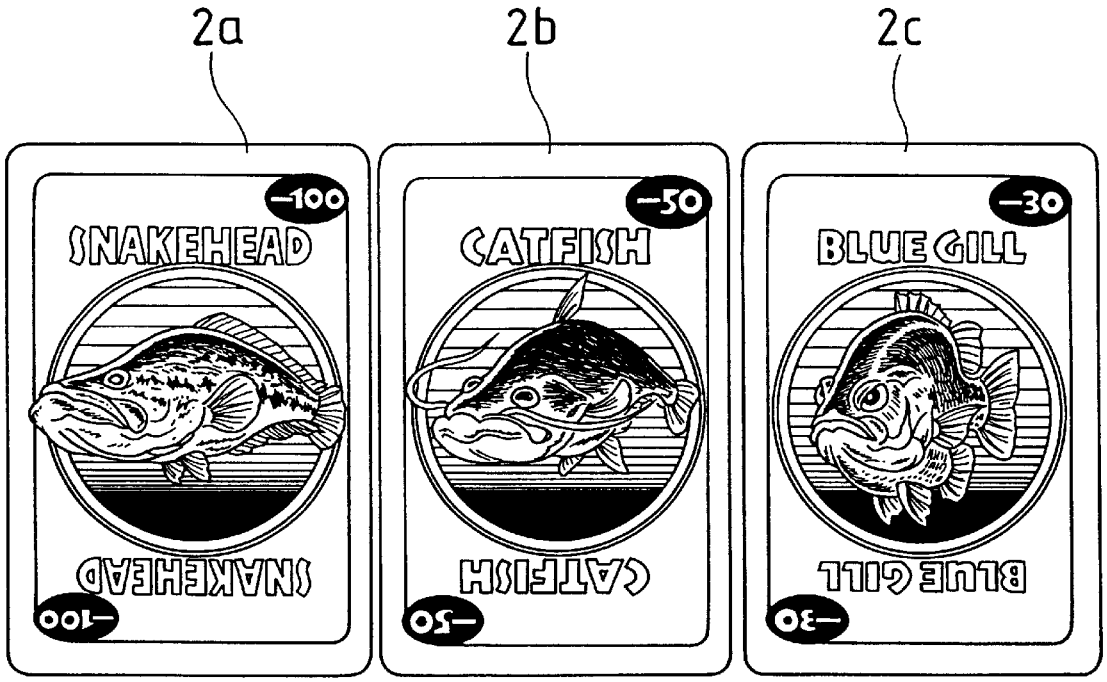
FIG. 2 shows observe sides of negative point cards.

When a player captures a negative point card 2*a*–2*c*, the points indicated thereon are subtracted from the player's points. There are prepared nine negative point cards, that is, two snakehead cards 2*a* with which 100 points are subtracted, three catfish cards 2*b* with which 50 points are subtracted, and four bluegill cards 2*c* with which 30 points are subtracted, as shown in FIG. 2.

Each negative point card 2*a*–2*c* indicates, on the observe side, negative points, a card name and an image of a corresponding fish.

Figure 3:
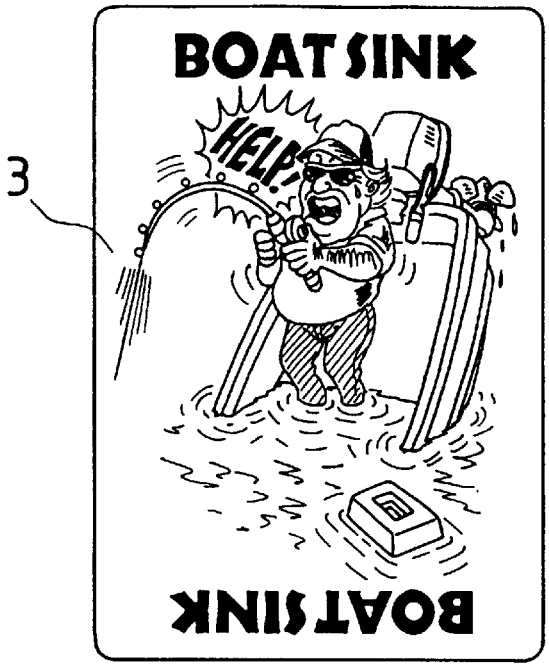
FIG. 3, shows an observe side of a point lose card.

When a player draws a point lose card 3, the player loses all the positive point cards which he or she has captured by that time. The card set comprises three point lose cards 3, each showing an image of a sinking boat and a name of the card on its observe side, as shown in FIG. 3.

Figure 4:
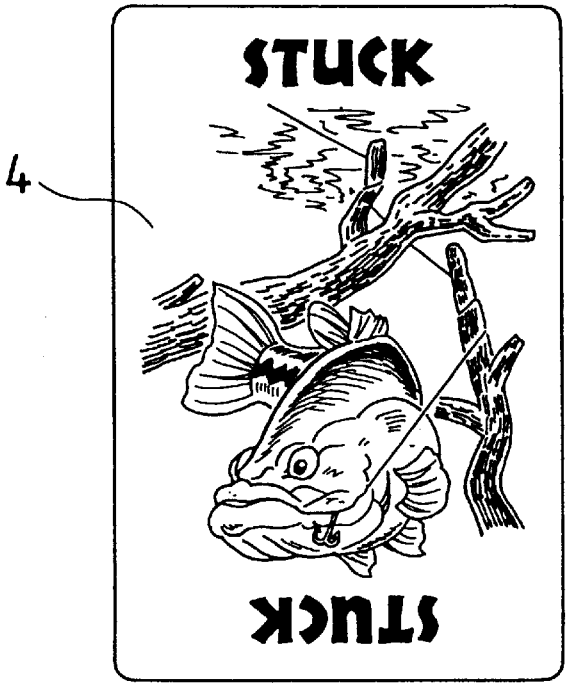
FIG. 4 shows an observe side of a rest card.

When a player draws a rest card 4, he or she must take a rest at the next turn. There are prepared two rest cards 4, each indicating an image of an entangled fishline and a name of the card on the observe side, as shown in FIG. 4.

The player cards comprise six kinds of point capture cards 5*a*–5*f* (FIG. 5) with an indication of at least one corresponding positive point card, hit cards 6 (FIG. 6) to be used in combination with point capture cards 5*a*–5*f*, and action cards 7 to 11. In the drawings, the hit card 6 and the action cards 7 to 11 are depicted different in size from the point capture cards 5*a*–5*f*, but actually they are all of the same size.

Figure 10:
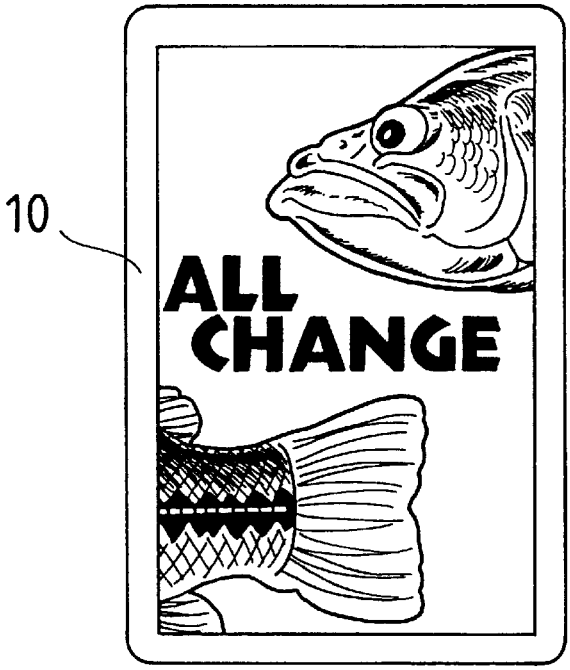
FIG. 10 shows an observe side of an all-change card.
Figure 11:
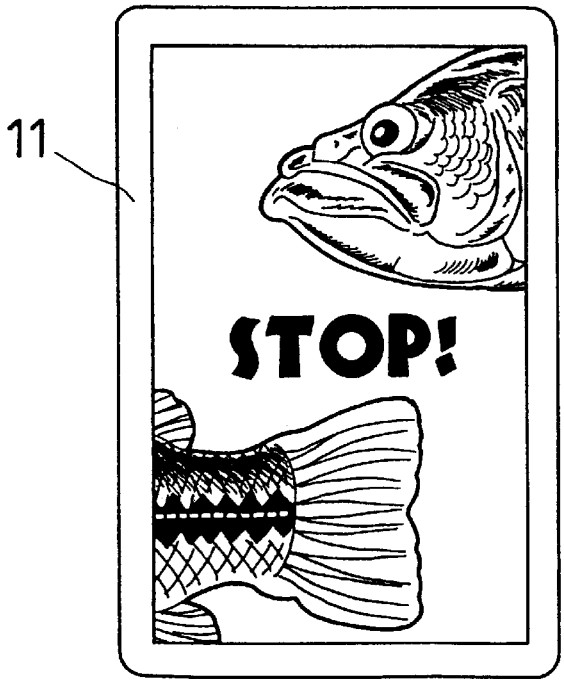
FIG. 11 shows an observe side of a stop card.

The action cards comprise steal cards 7 (FIG. 7), change cards 8 (FIG. 8), release cards 9 (FIG. 9), an all-change card 10 (FIG. 10), and stop cards 11 (FIG. 11). If a player presents a steal card 7 on a table in the player's turn, he or she can capture one point card (one of positive point cards 1*a*–1*e* or one of negative point card 2*a*–2*c*) from another player. If a player presents a change card 8 on the table in the player's turn, he or she can exchange one of the captured point cards with a point card captured by another player. If a player presents a release card 9 on the table in the player's turn, he or she can return one of the captured point cards or one of another player's captured point cards on the table. If a player presents an all-change card 10 on the table in the player's turn, he or she can exchange all the captured point cards with all the point cards captured by another player. If a player presents a stop card 11 on the table, he or she can cancel any action demanded by another action card.

Figure 5:
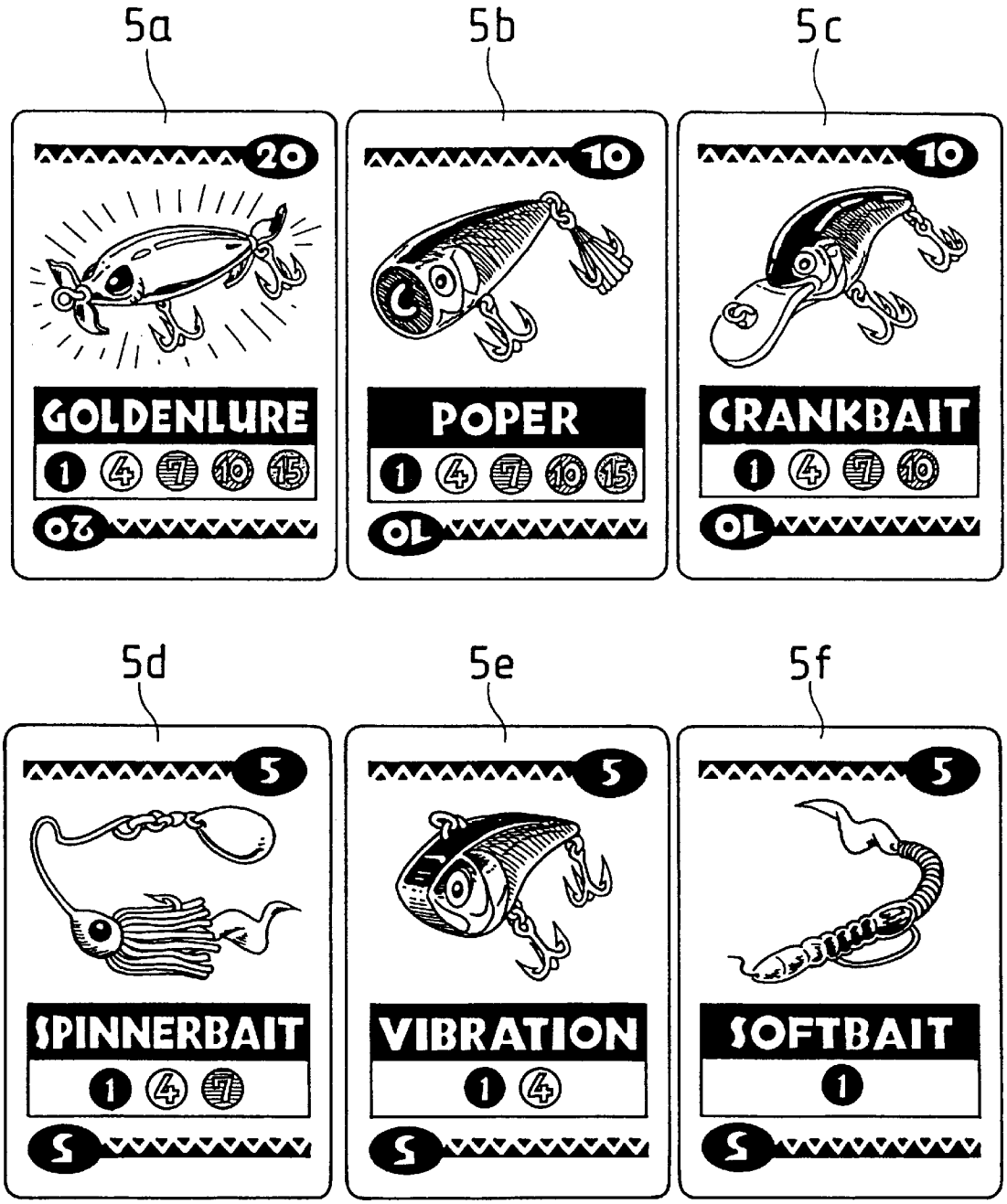
FIG. 5 shows observe sides of point capture cards.

The thirty-six point capture cards 5*a*–5*f* are prepared for capturing the point cards, including three goldenlure cards 5*a*, six poper cards 5*b*, seven crankbait cards 5*c*, nine spinnerbait cards 5*d*, six vibration cards 5*e* and five softbait cards 5*f*, as shown in FIG. 5.

If there is any point capture card 5*a*–5*f* having not been used and left in a player's hand when the game is over, the point capture card gives points to the player. Therefore, each point capture card 5 has indication of points to be given to the player as well as a name of the card such as "goldenlure", "poper", etc. and an image corresponding to the card name on its observe side.

Each of the point capture cards 5*a*–5*f* further indicates which kind of positive point cards 1*a*–1*e* correspond to the point capture card, for example, with an indication of fish sizes such as "70" and "60" on its observe side.

It is to be noted that any point capture card 5*a*–5*f* corresponds with any kind of the point cards other than the positive point cards 1*a*–1*e*, i.e. the negative point cards 2*a*–2*c*, the point lose cards 3 and the rest cards 4.

With the goldenlure card 5*a*, a player can capture any of the positive point cards 1*a*–1*e*. Further, a player can draw a point card three times in succession in one turn with the use of the goldenlure card 5*a*, while a player can draw a point card only once with the use of any of the other point capture cards 5*b*–5*f*. It is to be noted that when players are six or more, a player can draw a player card twice in one turn even with the use of the goldenlure card 5*a*. If the goldenlure card 5*a* is left in a player's hand when the game is over, 20 points are added to the player's points.

The poper card 5*b* is supposed to correspond to all of the positive point cards 1*a*–1*e*. If the poper card 5*b* is left in a player's hand when the game is over, 10 points are added to the player's points.

With the crankbait card 5*c*, a player can capture the 10 pounds-OVER card 1*b*, the 7 pounds-OVER card 1*c*, the 4 pounds-OVER card 1*d* or the 1 pound-OVER card 1*e*. If the crankbait card 5*c* is left in a player's hand when the game is over, 10 points are added to the player's points.

With the spinnerbait card 5*d*, a player can capture the 7 pounds-OVER card 1*c*, the 4 pounds-OVER card 1*d* or the 1 pound-OVER card 1*e*. If the spinnerbait card 5*d* is left in a player's hand when the game is over, 5 points are added to player's points.

The vibration card 5*e* corresponds with the 4 pounds-OVER card 1*d* and the 1 pound-OVER card 1*e*. If the vibration card 5*e* is left in a player's hand when the game is over, 5 points are added to player's points.

With the softbait card 5*f*, a player can capture only the 1 pound-OVER card 1*e*. If the softbait card 5*f* is left in a player's hand when the game is over, 5 points are added to player's points.

Figure 6:
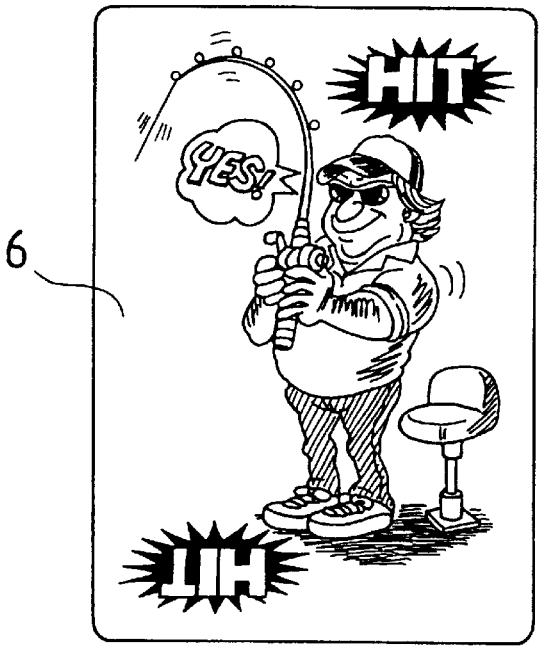
FIG. 6 shows an observe side of a hit card.

A player can draw a point card by presenting a hit card 6 on the table in combination with any of the point capture cards 5*a*–5*f* (any pair of one hit card 6 and one point capture card 5*a*–5*f*). Thus, the number of the hit cards 6 in the card set is set to 35 which is close to the number of the point capture cards 5*a*–5*f*. As shown in FIG. 6, the hit card 6 indicates a name of the card and an image suggesting that a fish is biting on the observe side.

Figure 7:
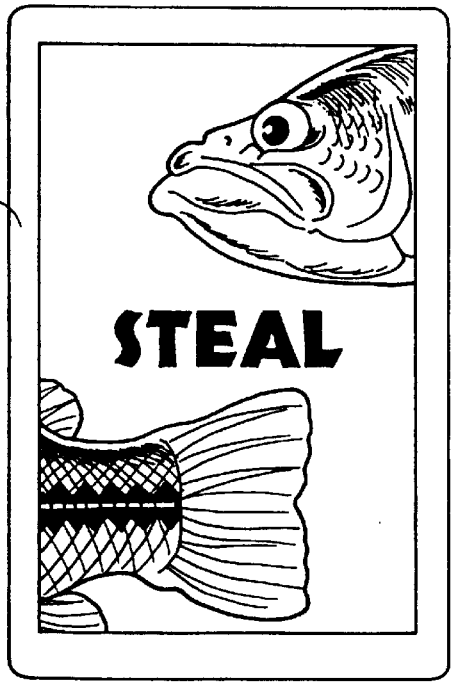
FIG. 7 shows an observe side of a steal card.

Four steal cards 7 are prepared in the card set. A player can obtain any one point card from the point cards which another player has captured, by presenting a steal card 7 on the table. The steal card 7 indicates a name of the card on the observe side, as shown in FIG. 7.

Figure 8:
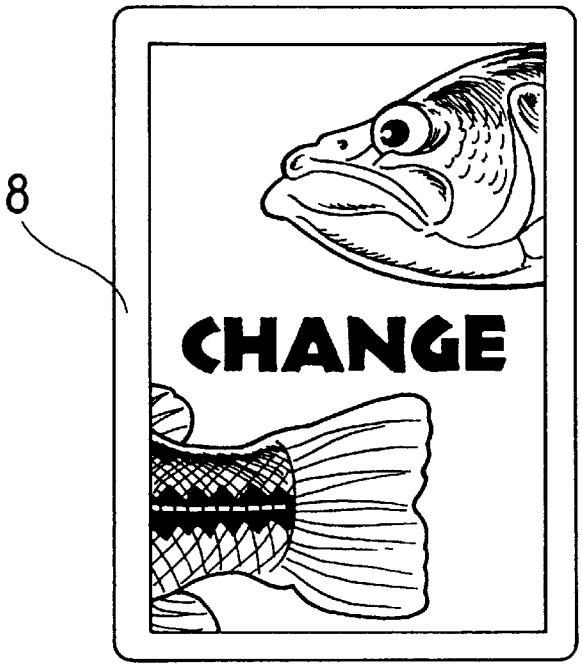
FIG. 8 shows an observe side of a change card.

Four change cards 8 are prepared in the card set. A player can exchange one of his or her own point cards with one of point cards of another player, by presenting a change card 8 on the table. This means that a player cannot use a change card 8 if he or she does not have a point card. The change card 8 indicates a name of the card on the observe side, as shown in FIG. 8.

A player may use the change card 8 in order to exchange his or her negative point card 2*a*–2*c* with another player's positive point card 1*a*–1*e*. However, with the change card 8, a player can also exchange his or her negative point card 2*a*–2*b* with another negative point card 2*b*–2*c* which brings smaller subtraction of points, or exchange his or her positive point card 1*b*–1*e* with another positive point card 1*a*–1*d* which brings larger addition of points.

Figure 9:
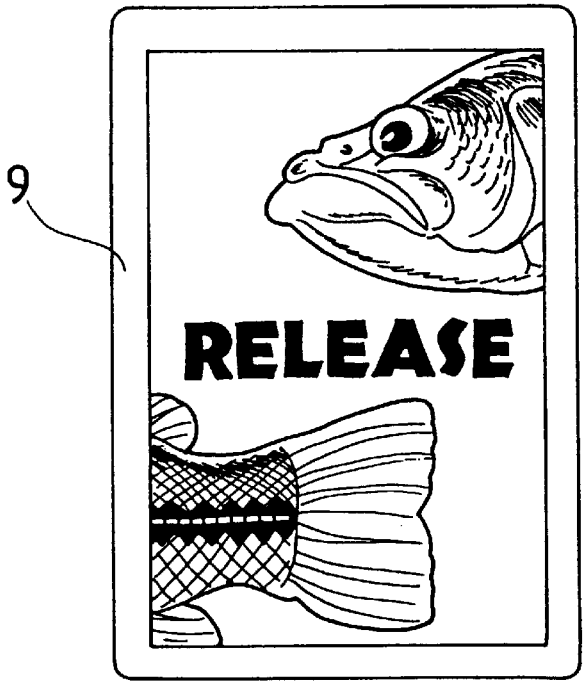
FIG. 9 shows an observe side of a release card.

Four release cards 9 are prepared in the card set. A player can return any one of his or her point cards or any one of another player's point cards on the table, by presenting a release card 9 on the table. The release card 9 indicates a name of the card its the observe side, as shown in FIG. 9.

Only one all-change card 10 is prepared in the card set. A player can exchange all of his or her point cards with all of the point cards that any one of the other players has, by presenting the all-change card 10 on the table.

When a player has no point cards, the player cannot use the all-change card 10 to obtain all the points cards another player has. The all-change card 10 indicates a name of the card on the observe side, as shown in FIG. 10.

The stop card 11 is a card with which a player can stop an action demanded by the other action card, i.e. the steal card 7, the change card 8, the release card 9 and the all-change card. Three stop cards 6 are prepared in the card set.

When an action card other than the stop card is presented on the table for a player, the player having the stop card 11 can stop the action demanded by the action card by presenting the stop card 11 on the table. The stop card 11 indicates a name of the card name on the observe side, as shown in FIG. 11.

The card game using the card set of the present invention is played as follows:

The point cards and the player cards are respectively cut sufficiently and laid with the observe sides down at separate positions on the table, to form a stack of point cards and a stack of player cards.

Players draw a player card from the top of the stack of the player cards one by one in the order determined by lot or the like. Each player keeps player cards which the player has drawn so that the other players cannot see the observe sides thereof.

Each player can, in his or her turn, choose a player card among the player cards which he or she has drawn to present it on the table.

Thus, what a player can do in his or her turn after drawing a player card from the stack is either to present a pair of one point capture card 5*a*–5*f* and one hit card 6 on the table or to present any one of the action cards, i.e. steal card 7, change card 8, release card 9 and all-change card 10 on the table.

Each player does not necessarily need to present a player card in his or her turn, but he or she is allowed to pass. Each player cannot present a player card twice or more in one turn.

A stop card 11 is not used by a player in his or her turn. Each player can use a stop card 11 when another player presents any one of the steal card 7, change card 8, release card 9 and all-change card 10 for the player. Each player can present a change card 8 only in combination with one of point cards which the player has (a positive point card 1*a*–1*e* or a negative point card 2*a*–2*c*).

By presenting a pair of a point capture card 5*a*–5*f* and a hit card 6 on the table, each player is allowed to draw one point card from the stack of the point cards. If the drawn point card is one of the positive point cards 1*a*–1*e*, the player can capture that positive point card only when it corresponds with the point capture card 5*a*–5*f* that the player has presented. The positive point card 1*a*–1*e* which the player cannot captured is left on the table with its observe side up. The point capture card 5*a*–5*f* and the hit card 6 that the player has presented are left on the table, whether or not the drawn positive point card corresponds with the point capture card 5*a*–5*f*.

All the point capture cards 5*a*–5*f* correspond with any of the negative point cards 2*a*–2*c*, point lose cards 3 and rest cards 4. Therefore, if a point card which a player has drawn is any of the negative point cards 2*a*–2*c*, point lose cards 3 and rest cards 4, the player must receive it. Also in this case, the point capture card 5*a*–5*f* and the hit card 6 the player has presented are left on the table.

Each player must place the point cards thus obtained with their observe sides up so that the other players can see the observe sides. If a player draws a point lose card 3, the player must present on the table all the positive point cards 1*a*–1*e* which the player has, and leave them on the table with their observe sides up. If a player draws a rest card 4, the player, in the next turn, returns the rest card 4 on the table with its observe side up and takes a rest.

The game is over either when the player cards stacked with the observe sides down are gone or when any one of the players has collected a predetermined number of positive point cards. The number of positive point cards with which the game terminates is predetermined depending on the number of players. If the players are two, the predetermined number of the positive point cards is set to eight, if the players are three to five, it is set to six, and if the players are six or more, it is set to five.

A winner is determined by the sum of the total points of the collected point cards and the total points of the point capture cards 5*a*–5*f* remaining in hand when the game is over. If a plurality of players have the same points, a player who has a stop card 11 is considered as a winner. If a winner is still not determined, a player who has the largest number of positive point cards 1*a* is determined to be a winner, and if a winner is then still not determined, a player who has the least number of negative point cards 2*c* is determined to be a winner.

Thus, a player needs to try to prevent, using the steal card 7, change card 8 and release card 9, another player from collecting the predetermined number of positive point cards to terminate the game, and at the same time try to collect positive point cards 1*a*–1*e*, using the steal card 7, change card 8 and all-change card 10, to increase his or her points.

The number of cards of each kind, the points of each card, kinds of cards and the like can be varied appropriately, and the number of cards with which the game ends can be varied accordingly. Further, the rule for determining a winner when a plurality of players have the same points is not limited to the above described way.

Further, the game card set does not need to imitate fishing. It may imitate fighting, hunting or the like. In such cases, the name and image of each card will be varied accordingly.

With the game card set of the present invention, players can enjoy a complicated and interesting game by combining different kinds of point cards and different kinds of player cards.

What is claimed is:

1. A set of cards for a game comprising:

a plurality of point cards bearing first symbol types including positive point cards of different kinds respectively indicating different positive numbers, and negative point cards of different kinds respectively indicating different negative numbers; and a plurality of player cards bearing second symbol types including:

point capture cards of different kinds respectively bearing indicia corresponding to at least one kind of said positive point cards; and hit cards bearing indicia representing combinability of said hit cards with said point capture cards to capture said at least one kind of positive point cards.

2. A set of cards for a game according to claim 1, wherein said point cards include a point losing card having indicia directing losing all of the positive point cards captured by a player.

3. A set of cards for a game according to claim 1, wherein said point cards include a rest card having indicia representing directing a player to take a rest at the next turn.

4. A set of cards for a game according to claim 1, wherein said player cards include an action card having indicia permitting a certain action by a player to be taken.

5. A set of cards for a game according to claim 4, wherein said action card comprises a steal card having indicia authorizing a player to steal a positive point card captured by another player.

6. A set of cards for a game according to claim 4, wherein said action card comprises a change card having indicia authorizing a player to exchange one point card captured by the player with one point card captured by another player.

7. A set of cards for a game according to claim 4, wherein said action card comprises a release card having indicia authorizing a player to return one point card captured by the player or one point card captured by another player on a table.

8. A set of cards for a game according to claim 4, wherein said action card comprises an all-change card having indicia authorizing a player to exchange all of the point cards captured by the player with all of the point cards captured by another player.

9. A set of cards for a game according to any one of claims 4 to 8, wherein said action card comprises a stop card having indicia directing a player to cancel any action demanded by another action card.

10. A set of cards for game according to claim 1, wherein said positive point cards and negative point cards have different colors on revere sides thereof.

* * * * *